US007237925B2

(12) United States Patent
Mayer et al.

(10) Patent No.: US 7,237,925 B2
(45) Date of Patent: Jul. 3, 2007

(54) LIGHTING APPARATUS FOR CREATING A SUBSTANTIALLY HOMOGENOUS LIT APPEARANCE

(75) Inventors: Mark J. Mayer, Sagamore Hills, OH (US); Paul Southard, Broadview Heights, OH (US)

(73) Assignee: Lumination LLC, Valley View, OH (US)

( * ) Notice: Subject to any disclaimer, the term of this patent is extended or adjusted under 35 U.S.C. 154(b) by 42 days.

(21) Appl. No.: 10/780,829

(22) Filed: Feb. 18, 2004

(65) Prior Publication Data

US 2005/0180135 A1 Aug. 18, 2005

(51) Int. Cl.
*F21V 7/00* (2006.01)

(52) U.S. Cl. ..... 362/247; 362/240; 362/249

(58) Field of Classification Search ..... 362/84, 362/240, 244, 245, 246, 247, 249, 310, 311, 362/800, 545

See application file for complete search history.

(56) References Cited

U.S. PATENT DOCUMENTS

| | | | | |
|---|---|---|---|---|
| 3,890,085 | A * | 6/1975 | Andeweg | 362/161 |
| 4,858,088 | A | 8/1989 | Agabekov | |
| 4,929,866 | A * | 5/1990 | Murata et al. | 362/310 |
| 5,317,489 | A * | 5/1994 | Gatti et al. | 362/157 |
| 5,337,225 | A | 8/1994 | Brookman | |
| 5,785,411 | A | 7/1998 | Komai et al. | |
| 6,042,248 | A | 3/2000 | Hannah et al. | |
| 6,082,870 | A | 7/2000 | George | |
| 6,158,882 | A | 12/2000 | Bischoff, Jr. | |
| 6,183,104 | B1 | 2/2001 | Ferrara | |
| RE37,113 | E | 3/2001 | Shimada | |
| 6,357,889 | B1 * | 3/2002 | Duggal et al. | 362/84 |
| 6,361,186 | B1 | 3/2002 | Slayden | |
| 6,394,626 | B1 | 5/2002 | McColloch | |
| 6,409,361 | B1 | 6/2002 | Ikeda | |
| 6,412,971 | B1 | 7/2002 | Wojnarowski et al. | |
| 6,416,200 | B1 | 7/2002 | George | |
| 6,478,450 | B1 | 11/2002 | Grajcar | |
| 6,491,412 | B1 | 12/2002 | Bowman et al. | |
| 6,505,956 | B1 | 1/2003 | Priddy et al. | |
| 6,601,970 | B2 * | 8/2003 | Ueda et al. | 362/247 |
| 2003/0021115 | A1 | 1/2003 | Sloan et al. | |
| 2003/0142492 | A1 * | 7/2003 | Sommers | 362/249 |
| 2003/0223235 | A1 * | 12/2003 | Mohacsi et al. | 362/240 |
| 2004/0012959 | A1 * | 1/2004 | Robertson et al. | 362/247 |

FOREIGN PATENT DOCUMENTS

| | | | | |
|---|---|---|---|---|
| DE | 20119861 | U1 * | 6/2002 | 362/249 |

OTHER PUBLICATIONS

International Search Report mailed Jun. 22, 2005 corresponding to International Application No. PCT/US2005/05053.

* cited by examiner

*Primary Examiner*—Y. My Quach-Lee
(74) *Attorney, Agent, or Firm*—Fay Sharpe LLP

(57) ABSTRACT

A lighting apparatus for creating a substantially homogenous lit appearance along the length of the apparatus is provided. The lighting apparatus includes an elongated envelope, an LED mounted in the elongated envelope, and a reflector. The elongated envelope includes a translucent portion. The reflector is positioned in relation to the LED such that the light emitted from the LED is directed toward the translucent portion of the elongated envelope and dispersed along the length of the lighting apparatus.

30 Claims, 4 Drawing Sheets

LIGHTING APPARATUS FOR CREATING A SUBSTANTIALLY HOMOGENOUS LIT APPEARANCE

BACKGROUND OF THE INVENTION

The invention relates generally to a lighting apparatus. More particularly, the invention relates to a lighting apparatus for creating a substantially homogenous lit appearance along the length of the lighting apparatus. The lighting apparatus finds particular application in simulating a neon light, however it is understood that the invention is also amenable to other applications.

Neon lights are widely used in architectural lighting systems to draw a viewer's attention to a building. Neon lights are fragile, require high voltage, consume large amounts of energy, and have an inconsistent life pattern. Therefore, many attempts have been made to replace neon lights with a more efficient and longer lasting lighting system.

In the art, light emitting diodes ("LEDs") have been used to simulate neon light. Such arrangements include mounting a plurality of LEDs linearly behind a lens to achieve a uniform lit appearance. These products use a circuit board with the LEDs spaced very close together, usually spaced at least 0.5 inches or closer. These systems consume more energy due to the number of LEDs per foot, and are prone to failure due to environmental intrusion. The reason for the proximity of the LEDs is to minimize dark or low intensity spots on the lens.

With wider spaced LEDs, the intensity distribution of the LEDs does not overlap enough and dark spots are apparent when viewed from a distance. Socket base LEDs have been used to alleviate environmental issues by removing the circuit board. Nevertheless, these systems generally have greater spacing between the LEDs, thus maximizing the size and appearance of dark spots on the lens.

Accordingly, it is desirable to provide a lighting apparatus having LEDs that creates a substantially homogenous lit appearance along the length of the lighting apparatus while overcoming the above mentioned deficiencies.

SUMMARY OF THE INVENTION

In accordance with one aspect of the invention, a lighting apparatus for creating a substantially homogenous lit appearance along the length of the apparatus is provided. The lighting apparatus includes an elongated envelope, an LED mounted in the elongated envelope, and a reflector. The elongated envelope includes a translucent portion. The reflector is positioned in relation to the LED such that the light emitted from the LED is directed toward the translucent portion of the elongated envelope.

In accordance with another aspect of the invention, the lighting apparatus includes an LED, an elongated lens cover for the LED, and a reflector. The reflector collimates light emitted from the LED in an axis substantially perpendicular to the length of the lighting apparatus and diffuses light along the length of the lighting apparatus.

DETAILED DESCRIPTION OF THE INVENTION

While the invention will be described in connection with the preferred embodiment, it is understood that it is not intended to limit the invention to that embodiment. On the contrary, the invention covers all alternatives, modifications and equivalents as may be included within the spirit and scope of the invention as defined by the appended claims.

Figure 1:
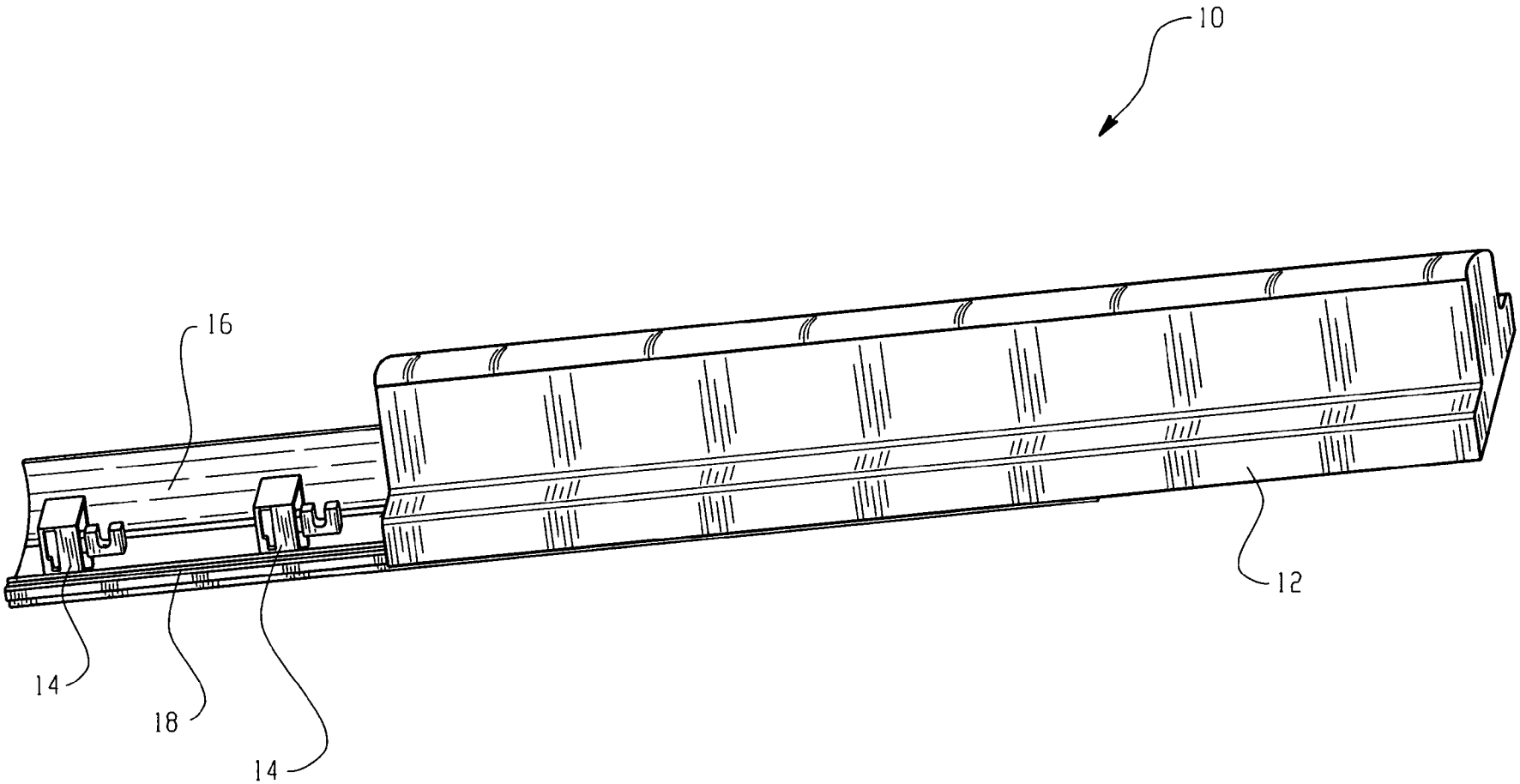
FIG. 1 is a perspective view of a lighting apparatus according to the present invention, where a portion of a support channel of the lighting apparatus is exposed.

As seen in FIG. 1, a lighting apparatus for creating a substantially homogenous lit appearance along the length of the apparatus includes an elongated envelope or cover 12, an LED 14 mounted in the envelope, and a reflector 16 also mounted in the elongated envelope. The lighting apparatus further includes a channel support 18 to which the LED 14 or a plurality of LEDs can be mounted.

Figure 2:
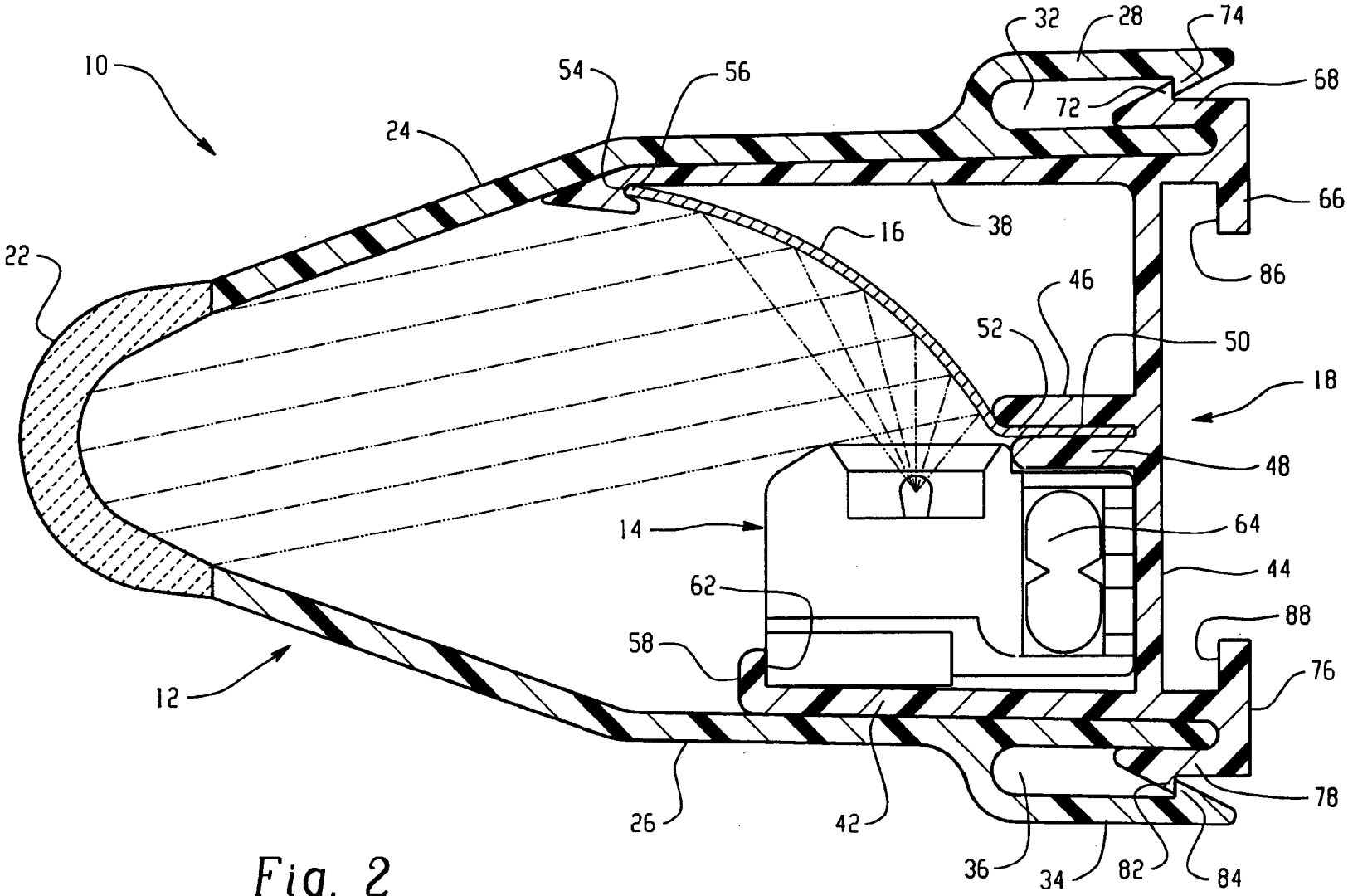
FIG. 2 is a side cross section view of the lighting apparatus of FIG. 1.

With reference to FIG. 2, the elongated envelope includes a translucent or transparent portion 22 (hereafter referred to as a translucent portion for the sake of brevity) and two opaque legs 24 and 26 that are interconnected by the translucent portion. The envelope can have a substantially sideways U-shaped or V-shaped configuration in cross-section. Preferably, the envelope will be made of an extruded plastic material. Furthermore, the translucent portion 22 will typically be colored to match the color of light emitted from the LED and the opaque legs will match the color of the translucent portion. A connecting leg 28 extends outwardly from an end of the opaque leg 24 opposite the translucent portion 22. The connecting leg 28 and the opaque leg 24 define a receiving channel 32. Similarly, the opaque leg 26 includes a connecting leg 34 extending outwardly from the end opposite the translucent portion. The connecting leg 34 and the opaque leg 26 define a receiving channel 36. The channels 32 and 36 are adapted to receive a portion of the channel support 18; the connection will be described in greater detail below.

With continued reference to FIG. 2, the channel support 18 includes a first leg 38, a second leg 42 spaced from the first leg and an interconnecting third leg 44 that is generally perpendicular to the first leg 38 and the second leg 42. The channel support is at least partially received inside the elongated envelope 12. The first leg 38 abuts a portion of the opaque leg 24 and the second leg 42 abuts a portion of the second opaque leg 26.

Protruding from the interconnecting leg 44 towards the translucent portion 22 are extensions 46 and 48. The extensions are located approximately midway between the first leg 38 and the second leg 42 and protrude perpendicular to the interconnecting leg 44. The first extension 46 protrudes from the interconnecting leg slightly farther towards the translucent portion than the second extension 48. The extensions define a channel 50. A first terminal portion 52 of the reflector 16 is received in the channel 50. The first leg 38 of the channel support 18 includes a notch 54 at an end nearest the translucent portion 22. The notch 54 receives a second terminal portion 56 of the reflector 16 opposite the first terminal portion 52.

The second leg 42 includes a projection 58 at an end nearest the translucent portion 22. The projection 58 protrudes substantially perpendicular to the second leg 42 towards the first leg 38. The projection 58, the second leg 42, the interconnecting leg 44 and the extension 48 define a channel 62 that receives the LED 14 and its power components.

The LED 14 depicted in the figures is a conventional LED that is known in the art. The LED 14 receives power from a power cord 64 that is attached to an external power source. The power cord is flexible, and covered by a plastic liner for protection from the elements, however in an alternative embodiment the LEDs can also mount to a circuit board. As seen in FIG. 2, to mount the LED 14 to the channel support 18, a portion of the LED and the power cord is sandwiched between the second extension 48 and the second leg 42 and the LED 14 and the power cord 64 are sandwiched between the projection 58 and the interconnecting wall 44. Mounting can be achieved via a frictional fit, or an adhesive or fasteners can be provided to attach the LED to the channel support.

The first leg 38 of the channel support 18 includes a foot 66 at an end opposite the notch 54. The foot 66 is spaced from and substantially perpendicular to the interconnecting wall 44. Projecting from an end of the foot 66 into the receiving channel 32, an extension 68 includes a barb 72 that abuts against a barb 74 of the connecting leg 28 to fasten the channel support 18 to the elongated envelope 12. Likewise, the second leg 42 includes a foot 76 at an end opposite of the projection 58. An extension 78 protrudes away from the foot 76 and into the receiving channel 36, where the extension 78 includes a barb 82 that abuts against a barb 84 so that the channel support 18 fastens to the elongated envelope 12. The barbs provide a frictional engagement between the channel support 18 and the elongated envelope 12. Referring back to FIG. 1, the channel support 18 can be removed from the elongated envelope 12 by sliding the channel support in a longitudinal direction.

The feet 66 and 76 also cantilever over a portion of the interconnecting leg 44. The foot 66, the first leg 38 and the interconnecting leg 44 define a channel 86. Similarly, the foot 76, the second leg 42 and the interconnecting leg 44 define a channel 88. The feet 66 and 76 act as engagement members and the channels 86 and 88 are dimensioned to receive connecting members (not shown) that are affixed to an architectural structure. Also the channels 86 and 88 can receive connecting members (not shown) that can attach one lighting apparatus to an adjacent lighting apparatus.

The reflector 16 will now be described in more particularity using the terms horizontal and vertical axis. The horizontal axis runs along the length of the lighting apparatus 10 and the vertical axis is parallel to the interconnecting leg 44 of the channel support 18. These terms are used only to facilitate the description of the reflector as it appears in the figures, and are not meant to limit the invention to such a configuration. The LED faces the reflector and faces perpendicular to the direction that the translucent portion 22 runs (i.e., the length of the envelope) so the light emitted from the LED strikes the reflector before striking the translucent cover, which lessens the likelihood that dark spots are apparent to a viewer at a distance from the lighting apparatus.

Figure 3:
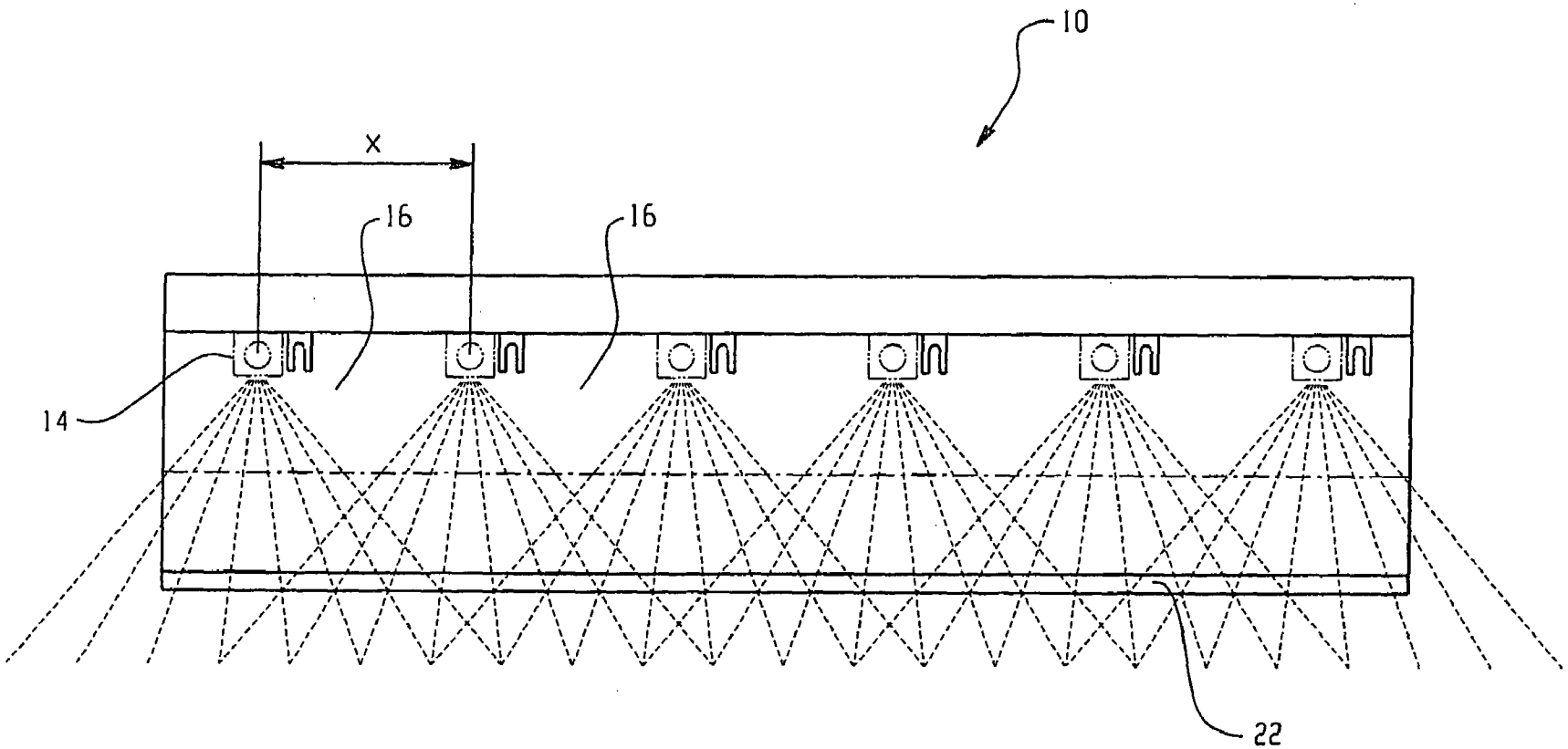
FIG. 3 is a plan view of the lighting apparatus of FIG. 1 with LEDs and reflector shown in phantom demonstrating dispersion of light along the lighting apparatus.

In FIG. 2, the reflector 16 is shaped such that it focuses light along the vertical axis of the lighting apparatus and spreads light in the horizontal axis. In the side cross section of FIG. 2, the reflector 16 is arcuate in shape. As seen in FIG. 2, the arcuate shape focuses the light emitted from the LED 14 towards the translucent portion 22. The reflector is not curved in the horizontal axis, and appears planar when viewed from a front elevation view. Because the reflector is not curved in the horizontal plane, the reflector does not focus the light in the horizontal direction. As seen in FIG. 3, the reflector 16 disperses the light along the length of the lighting apparatus 10. Accordingly, dark spots are not visible along the length of the lighting apparatus, yet the LEDs can be spaced from one another such that energy efficiencies can be achieved.

Even though the cross section of the reflector 16 shown in FIG. 2 is arcuate, it can take other shapes as well, such as linear or a more complex curved shape. The reflector can be made from 100% specular material to 100% diffused material depending on the desired intensity and needed uniformity. The reflector can be made from white diffused plastic, metallic self-adhesive tape, a formed metal reflector, a vacuum metalized surface, as well as others. The more diffused surfaces provide greater uniformity but with lower emitted intensity. The more specular surfaces have greater intensities with a greater risk of showing intensity variations along the translucent portion. The reflector can also be made from a commercially available material having diffusion properties that differ along the vertical and horizontal axis. Selecting a material that has a greater diffusion in the horizontal axis while maintaining more specularity in the vertical axis can provide greater uniformity of light along the length of the lighting apparatus.

Also noticeable in FIG. 2, collection of light in the vertical axis increases the intensity of the light by minimizing side wall reflections. Notice how the reflector 16 is shaped and positioned so that the light emitted from the LED is directed from the LED to the reflector, which directs the light towards the translucent portion 22 without any light striking the opaque walls 24 and 26. Also, the shape of the reflector increases the light uniformity, as visible in FIG. 3, by overlapping the intensity distribution in along the length of the lighting apparatus.

With reference to FIG. 3, the plurality of LEDs are spaced apart from one another. With the use of the reflector 16 the LEDs can be spaced farther apart from one another than known neon light simulating apparatus. For example, the distance x between the midpoints of adjacent LEDs is greater than 0.5 inches. Preferably, the spacing x is about 2 inches.

Depending on the color of light desired to be emitted by the lighting apparatus 10, components or elements can be added to the apparatus. For example, if a white light is to be emitted by the apparatus a phosphor can be added to the apparatus. Obviously, LEDs that emit white light can be used in the apparatus; however white LEDs have a shorter life and consume more energy than a standard blue LED. In one example of adding phosphor to the apparatus, a standard blue LED emitter can reflect off of a reflector that has been coated with an efficient matching phosphor to create a reflected white light. The phosphor can be dipped, sprayed, imbedded, as well as other known methods onto or into the reflector to achieve the desired reflected output. In another example, the translucent portion 22 of the apparatus 10 can be coated with a phosphor. Like wise, the phosphor can be dipped, sprayed, imbedded, as well as other known methods onto or into the translucent portion to achieve the desired output.

Figure 4:
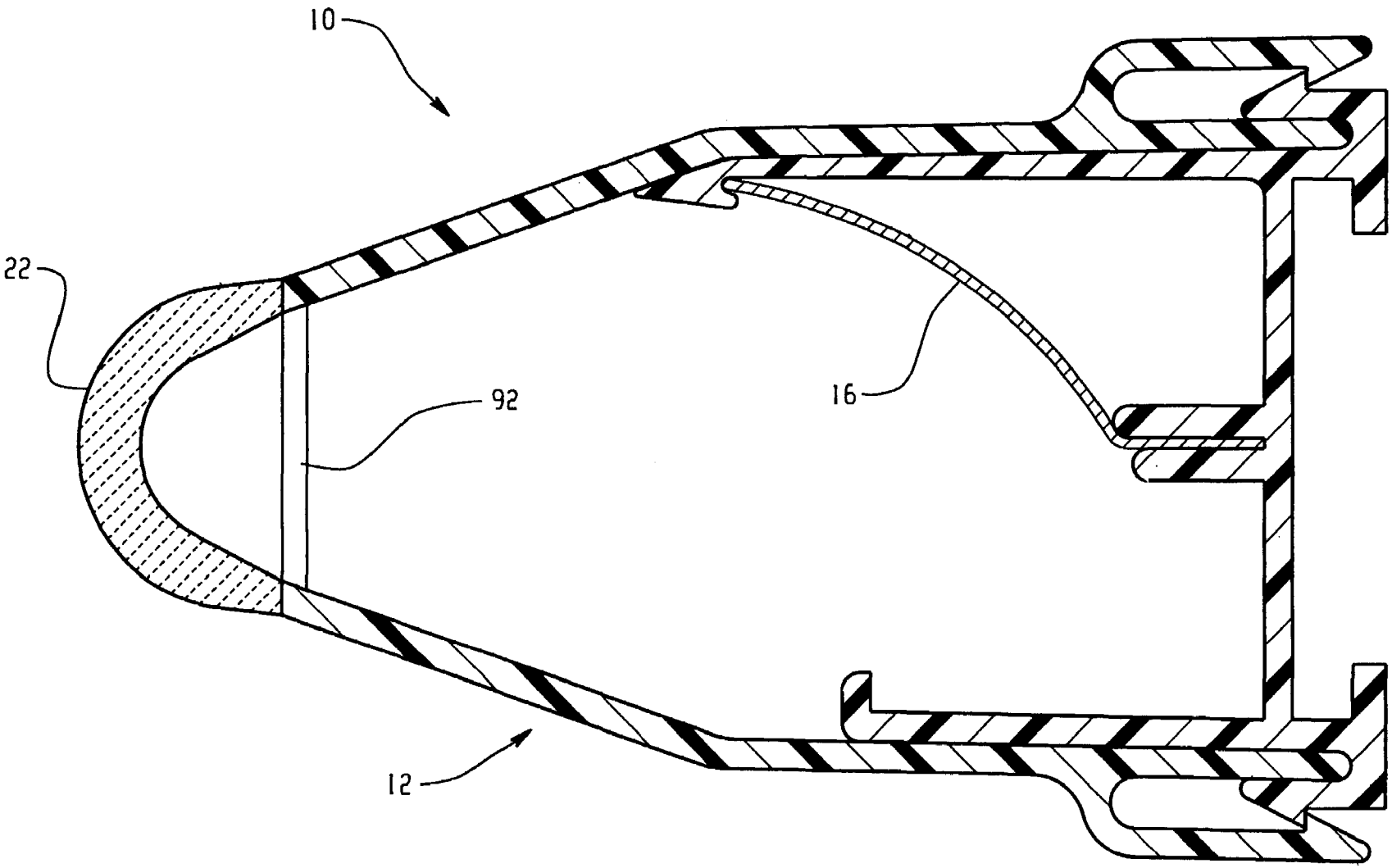
FIG. 4 is a side cross section view of a lighting apparatus according to an alternative embodiment, with the light source removed from the apparatus.

In an alternative embodiment, as shown in FIG. 4, a phosphor insert 92 is interposed between the reflector 16 and the translucent portion 22. Blue light emitted from the LED is visible as white light emitted from the translucent portion after the light travels through the phosphor insert 92.

Having thus described the invention with reference to the accompanying drawings, it is to be understood that the invention is not limited to those precise embodiments. Various changes and modifications may be effected by one skilled in the art without departing from the scope or spirit of the invention as defined in the claims.

What is claimed is:

1. A lighting apparatus for creating a substantially homogenous lit appearance along the length of the apparatus, the apparatus comprising:

an elongated envelope including a light-transmissive portion, wherein said envelope defines a first axis along its length;

an LED mounted in said elongated envelope;

a reflector positioned in relation to said LED such that light emitted from said LED is directed from said reflector toward the light-transmissive portion of said elongated envelope, said reflector adapted to focus light toward a second axis that is at least substantially perpendicular to the first axis, said reflector comprises a material having greater light diffusing properties along a first axis than along a second axis.

2. The lighting apparatus of claim 1, further comprising a channel support attached to said elongated envelope opposite the light-transmissive portion, wherein said LED mounts to said channel support and said channel support includes engagement members adapted to receive associated connecting members.

3. The lighting apparatus of claim 1, wherein said reflector is adapted to spread light emitted from said LED along the first axis.

4. The lighting apparatus of claim 1, wherein said reflector is arcuate in a cross-section taken substantially normal to the first axis.

5. The lighting apparatus of claim 1, wherein said LED faces substantially perpendicular to the light-transmissive portion of said elongated envelope.

6. The lighting apparatus of claim 1, further comprising a second LED, wherein said LEDs are positioned greater than 0.5 inches away from one another.

7. The lighting apparatus of claim 1, further comprising a flexible power cord, wherein said LED attaches to said flexible power cord.

8. The lighting apparatus of claim 1, wherein said elongated envelope includes a first opaque leg and a second opaque leg interconnected by said light-transmissive portion, and said reflector is adapted to direct light toward said light-transmissive portion such that the light does not strike at least one of the first and second opaque legs.

9. A lighting apparatus for creating a substantially homogenous lit appearance along the length of the apparatus, the apparatus comprising:

an extruded elongated envelope defining a first axis along its length and having a general U-shape or V-shape configuration in a cross-section taken normal to the first axis, said envelope including a light-transmissive portion running at least substantially parallel to the first axis and an opaque portion adjacent the light-transmissive portion and formed integrally with the light-transmissive portion;

a plurality of LEDs mounted in said elongated envelope aligned with the first axis; and a reflector disposed adjacent said LEDs, said reflector being shaped and positioned in relation to said LEDs such that light emitted from said LEDs is directed from said reflector towards the light-transmissive portion of said elongated envelope and dispersed along the light-transmissive portion.

10. The lighting apparatus of claim 9, wherein said opaque portion comprises first and second opaque legs and said light-transmissive portion is disposed between the opaque legs.

11. A lighting apparatus comprising:

an elongated envelope including a first opaque leg and a second opaque leg interconnected by a light-transmissive portion, the envelope defining a first axis along its greatest dimension and a second axis transverse to the first axis;

a plurality of LEDs mounted in said elongated envelope; and a reflector positioned in relation to said LEDs such that light emitted from said LEDs is directed from said reflector toward the light-transmissive portion of said elongated envelope.

12. The lighting apparatus of claim 11, wherein said reflector is shaped such that it focuses light along the second axis and disperses light along the first axis.

13. The lighting apparatus of claim 11, wherein said reflector comprises a material that diffuses more light along the first axis than along the second axis.

14. The lighting apparatus of claim 11, wherein said reflector is adapted to direct light such that light emitted from adjacent LEDs overlaps.

15. The lighting apparatus of claim 11, wherein said reflector is curved in a cross section that is taken substantially normal to the first axis.

16. The lighting apparatus of claim 15, wherein said reflector is parallel to the first axis in a cross section that is taken substantially normal to the second axis.

17. The lighting apparatus of claim 16, wherein said LEDs are spaced greater than 0.5 inches away from one another.

18. The lighting apparatus of claim 11, further comprising a phosphor portion positioned in relation to said LED such that light emitted from said LED either reflects off and/or passes through said phosphor portion.

19. The lighting apparatus of claim 18, wherein said phosphor portion is affixed to or embedded in said light-transmissive portion.

20. The lighting apparatus of claim 18, wherein said phosphor portion is affixed to or embedded in said reflector.

21. The lighting apparatus of claim 18, wherein said phosphor portion comprises a phosphor insert interposed between said reflector and said light-transmissive portion.

22. The lighting apparatus of claim 11, further comprising a support connected to said elongated envelope opposite the light-transmissive portion, said LEDs being mounted on said support.

23. The lighting apparatus of claim 22, further comprising a flexible power cord disposed in a channel defined by said support, wherein said LEDs mount to said flexible power cord.

24. A lighting apparatus for creating a substantially homogenous lit appearance along the length of the apparatus, the apparatus comprising:

an elongated envelope including a light-transmissive portion;

a flexible power cord;

an LED attached to said flexible power cord; and a reflector positioned in relation to said LED such that light emitted from said LED is directed from said reflector toward the light-transmissive portion of said elongated envelope, said reflector being configured to focus light towards a first axis and to disperse light along a second axis.

25. The lighting apparatus of claim 24, wherein the flexible power cord runs along a length of the envelope.

26. The lighting apparatus of claim 24, wherein the light-transmissive portion is translucent.

27. The lighting apparatus of claim 24, wherein said LED faces the reflector.

28. The lighting apparatus of claim 27, wherein said LED faces perpendicular to a direction in which the light-transmissive portion runs.

29. The lighting apparatus of claim 24, wherein the first axis is generally perpendicular to the second axis.

30. The lighting apparatus of claim 24, wherein said reflector is configured to develop an overlapping light intensity distribution along the first axis.

* * * * *